US010419871B2

(12) United States Patent
Jin et al.

(10) Patent No.: US 10,419,871 B2
(45) Date of Patent: Sep. 17, 2019

(54) METHOD AND DEVICE FOR GENERATING AN ELEVATED SOUND IMPRESSION

(71) Applicant: Huawei Technologies Co., Ltd., Shenzhen (CN)

(72) Inventors: Wenyu Jin, Munich (DE); Simone Fontana, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/862,807

(22) Filed: Jan. 5, 2018

(65) Prior Publication Data

US 2018/0132054 A1 May 10, 2018

Related U.S. Application Data

(63) Continuation of application No. PCT/EP2015/073801, filed on Oct. 14, 2015.

(51) Int. Cl.
*H04R 3/12* (2006.01)
*H04S 3/02* (2006.01)
(Continued)

(52) U.S. Cl.
CPC ..... *H04S 7/307* (2013.01); *H04R 3/12* (2013.01); *H04S 3/002* (2013.01); *H04S 3/02* (2013.01);
(Continued)

(58) Field of Classification Search
CPC ... H04R 2499/13; H04R 3/12; H04S 2420/01; H04S 2420/13; H04S 3/002; H04S 3/02; H04S 7/307
(Continued)

(56) References Cited

U.S. PATENT DOCUMENTS 9,986,338 B2 * 5/2018 Mansfield ..... H04R 5/02
2007/0230729 A1 * 10/2007 Naylor ..... H04R 25/407 381/320
(Continued)

FOREIGN PATENT DOCUMENTS

| | | | |
|---|---|---|---|
| CN | 105392096 | A | 3/2016 |
| EP | 1830604 | A1 | 5/2007 |
| EP | 1841281 | A1 | 10/2007 |
| JP | 2003230198 | A | 8/2003 |
| WO | 2014082683 | A1 | 6/2014 |

OTHER PUBLICATIONS

Lopez J. J. et Al (."Elevation in Wave-Field Synthesis Using HRTF Cues", Acustica United with Acta Acustica, S. Hirzel Verlag, Stuttgart, Germany, vol. 96, Mar. 1, 2010, pp. 340-350, XP009187155, ISSN: 1610-1928).*
(Continued)

*Primary Examiner* — Paul Kim
*Assistant Examiner* — Friedrich Fahnert
(74) *Attorney, Agent, or Firm* — Slater Matsil, LLP

(57) ABSTRACT

A sound field device is disclosed that comprises an elevation cue estimator, a low-frequency filter estimator, and a high-frequency filter estimator. The elevation cue-estimator is configured to estimate an elevation cue of a head-related transfer function (HRTF) of at least one listener. The low-frequency filter estimator is configured to estimate one or more low-frequency filter elements based on the elevation cue. The high-frequency filter estimator is configured to estimate one or more high-frequency filter elements based on the elevation cue. An estimation method of the low-frequency filter estimator is different from an estimation method of the high-frequency filter estimator. The one or more low-frequency filter elements and the one or more high-frequency filter elements are for driving an array of loudspeakers to generate an elevated sound impression at a bright zone.

20 Claims, 5 Drawing Sheets

(51) Int. Cl.
*H04S 3/00* (2006.01)
*H04S 7/00* (2006.01)

(52) U.S. Cl.
CPC ..... *H04R 2499/13* (2013.01); *H04S 2420/01* (2013.01); *H04S 2420/13* (2013.01)

(58) Field of Classification Search
USPC ..... 381/17, 98, 320
See application file for complete search history.

(56) References Cited

U.S. PATENT DOCUMENTS

| | | | | |
|---|---|---|---|---|
| 2011/0135098 | A1* | 6/2011 | Kuhr | H04S 3/004 381/17 |
| 2011/0261973 | A1* | 10/2011 | Nelson | H04S 3/00 381/92 |
| 2014/0334626 | A1* | 11/2014 | Lee | H04S 5/00 381/17 |
| 2015/0289059 | A1* | 10/2015 | Christoph | H04S 7/301 381/97 |
| 2016/0330560 | A1* | 11/2016 | Chon | H04S 5/005 |
| 2017/0034623 | A1* | 2/2017 | Christoph | H04R 5/027 |
| 2017/0034639 | A1* | 2/2017 | Chon | G10L 19/008 |
| 2017/0332182 | A1 | 11/2017 | Minnaar | |

OTHER PUBLICATIONS

Russell, D.A. et al., "Acoustic monopoles, dipoles, and quadrupoles: An experiment revisited," American Journal of Physics, vol. 67, Issue 8, Published Online: Jul. 1999 Accepted: Dec. 1998, 6 pages.

Williams, E. G., "Fourier Acoustics: Sound Radiation and Nearfield Acoustical Holography", J. Acoustical Society of America 108 (4), Oct. 2000. pp. 1373-1374.

Lopez, J. J. et al., "Elevation in Wave-Field Synthesis Using HRTF Cues", Acta Acustica United with Acustica, vol. 96, Nov. 12, 2010, pp. 340-350.

Lopez, J. J. et al., "Rear and Side Reproduction of Elevated Sources in Wave-Field Synthesis", in Proceedings of the 17th European Signal Processing Conference (EUSIPCO 2009), Glasgow, UK, Aug. 24-28, 2009, 5 pages.

Lopez, J.J., "Elevation in Wave-Field Synthesis Using HRTF Cues", Acta Acustica United with Acustica, vol. 96, No. 2, Mar. 1, 2010, XP009187155, pp. 340-350.

Morimoto, M. et al., "3-D Sound Image Localization by Interaural Differences and the Median Plane HRTF". Proceedings of the 2002 International Conference on Auditory Display, Kyoto, Japan, Jul. 2-5, 2002, 6 pages.

Poletti, M., "An Investigation of 2D Multizone Surround Sound Systems", Audio Engineering Society Convention Paper 7551, 125th Convention. Oct. 2008, 9 pages.

Coleman, P. et al., "Acoustic contrast, planarity and robustness of sound zone methods using a circular loudspeaker array", The Journal of the Acoustical Society of America, vol. 135, No. 4, pp. 1929-1940, Feb. 10, 2014.

Okamoto, T. "Generation of Multiple Sound Zones by Spatial Filtering in Wavenumber Domain Using a Linear Array of Loudspeakers", in Acoustics, Speech and Signal Processing (ICASSP), 2014 IEEE International Conference on, May 2014, pp. 4733-4737.

Algazi, V. R. et al., "The CIPIC HRTF Database", Proceedings of IEEE ICASS☆ 01, New Paltz, NY, USA, Oct. 21-24, 2001. pp. 99-102.

* cited by examiner

METHOD AND DEVICE FOR GENERATING AN ELEVATED SOUND IMPRESSION

CROSS-REFERENCE TO RELATED APPLICATIONS

This application is a continuation of International Application No. PCT/EP2015/073801, filed on Oct. 14, 2015, the disclosure of which is hereby incorporated by reference in its entirety.

TECHNICAL FIELD

The present application relates to a sound field device, an audio system, a method for determining filter elements for driving an array of loudspeakers to generate an elevated sound impression at bright zone and a computer-readable storage medium.

BACKGROUND

Sound is central to the interaction of humans with their environment. As a result, a major technological objective has been to control the sound in a particular physical environment for purposes such as communication or entertainment. At the current state of art, simply reproducing the sound of a single source is straightforward. However, the reproduction or creation of complex audio scenarios is still difficult. This is especially true for the case of rendering various individual three-dimensional (3D) sound environments over multiple listening areas simultaneously, which generally requires a large number of loudspeakers with 3D setup and results in high computational complexity.

The natural solution to create multiple sound environments independently is to create multiple sets of bright and quiet zones over the selected regions, so that the inter-zone sound leakages can be minimized. This so-called multi zone sound field reproduction has widely received the attention of researchers.

There is an interest in reproducing various 3D sound environments over multiple listening areas using a single two-dimensional (2D) speaker array. This is achieved by performing at least one of amplifying, attenuating, and delaying processes on each of the replicated source signals based on the predetermined filters for each of the loudspeakers. The sound field in a space is normally modeled as a linear and time-invariant system. The actual sound field $s^a(x,t)$ at a point x at time t can be written as a linear function of the signal transmitted by the source s(t). For a fixed source, the position-dependent acoustic impulse response h(x; t) can be modeled at each time t:

$$s^a(x;t)=h(x,t)*s(t).$$

Taking the Fourier transform with respect to wave number k, the acoustic transfer function H(x; k) is defined as the complex gain between the frequency domain quantities of source driving signal s(k) and the actual sound field $S^a(x;k)$:

$$S^a(x,k)=H(x,k)s(k).$$

As mentioned above, the source driving signal s(k) is derived by amplifying, attenuating, and delaying the input signal or filtering the latter with head-related transfer function (HRTF) spectrum cues. HRTF is a frequency response that characterizes how an ear receives a sound from a point in space; it is a transfer function, describing how a sound from a specific point will arrive at the ear (generally at the outer end of the auditory canal).

Current surround sound standards (e.g. 5.1/10.2 surround) are characterized by a single listener location or sweet spot where the audio effects work best, and present a fixed or forward perspective of the sound field to the listener at this location; these works are incapable of providing multiple individual sound environments over arbitrary listening zones. There are some existing multi zone sound rendering systems based on sound field synthesis approaches (e.g. higher order ambisonics (HOA) based methods, planarity control methods, and spectral division methods). However, these works are restricted to virtual source localization on the horizontal plane.

To achieve the sensation of 3D elevated sources (or virtual sources below the horizontal plane) in existing systems, additional loudspeakers in a third dimension or changing the reproduction set-up to 3D are generally needed (e.g., 22.2 surround and 3D spherical loudspeaker arrays). However, the 3D array with a relatively large number of speakers is not practical to employ in real-world. Additionally, the computational complexity also increases significantly as the number of speaker channels goes up.

SUMMARY

Certain embodiments of the present application provide a sound field device, an audio system and a method for determining filter elements for driving an array of loudspeakers to generate an elevated sound impression at a bright zone, wherein the sound field device, the audio system and the method for determining filter elements for driving an array of loudspeakers to generate an elevated sound impression at bright zone overcome one or more of the herein-mentioned problems of the current techniques.

Spectral elevation cues of HRTF can be applied to existing sound field reproduction approaches to create the sensation of elevated virtual sources within the specified control region. A cascaded combination of HRTF elevation rendering with a 2D wave field synthesis system that controls the azimuth angle of the reproduced wave field can be used. However, such an approach lacks the ability to deliver various 3D sound contents over multiple regions.

A first aspect of the application provides a sound field device configured to determine filter elements for driving an array of loudspeakers to generate an elevated sound impression at a bright zone. The device comprises an elevation cue estimator, a low-frequency filter estimator, and a high-frequency filter estimator. The elevation cue estimator is configured to estimate an elevation cue of an HRTF of at least one listener. The low-frequency filter estimator is configured to estimate one or more low-frequency filter elements based on the elevation cue. The high-frequency filter estimator is configured to estimate one or more high-frequency filter elements based on the elevation cue. An estimation method of the low-frequency filter estimator is different from an estimation method of the high-frequency filter estimator.

The sound field device of the first aspect can drive an array of 2D loudspeakers such that a desired 3D sound corresponding to a source elevation is reproduced over multiple listening areas. The device combines the use of elevation cues of an HRTF in conjunction with a horizontal multi zone sound system. The use of dual-band filter estimators allows accurate reproduction of the desired 3D elevated sound with the consideration of HRTF at the bright zone, as well as reduction of the sound leakage to the quiet zones over the entire audio frequency band.

For example, the low-frequency filter estimator uses a first estimation method which is different from a second estimation method of the high-frequency filter estimator. The first estimation method and the second estimation method are different in the sense that they use different kinds of computations for arriving at the filter estimators. For example, the first estimation method and the second estimation method do not only use different parameters, but also different computational approaches for computing the low-frequency and high-frequency filter elements.

For example, each of the low-frequency filter elements corresponds to one of the loudspeakers of the array of the loudspeakers. Similarly, each of the high-frequency filter elements corresponds to one of the loudspeakers of the array of loudspeakers.

In embodiments of the application, the low-frequency filter estimator is configured to estimate a plurality of filter elements for each loudspeaker of the array of loudspeakers. The filter elements of the plurality of filter elements correspond to different low frequencies. Similarly, the high-frequency filter estimator can be configured to estimate a plurality of filter elements for each loudspeaker of the array of loudspeakers. The filter elements of the plurality of filter elements correspond to different high frequencies.

In embodiments of the application, the sound field device comprises not only a low-frequency filter estimator and a high-frequency filter estimator, but also further comprises estimators that are specific to certain frequency ranges and that use estimation methods that are different from the estimation method of the low-frequency filter estimator and/or the high-frequency filter estimator.

In a first implementation of the sound field device according to the first aspect, the low-frequency filter estimator comprises an optimizer configured to determine the one or more low-frequency filter elements by optimizing an error measure. The error measure is between a desired sound field at one or more control points of the bright zone, weighted by or based on the elevation cue and an estimate of a transfer function that represents a channel from the array of loudspeakers to the one or more control points of the bright zone.

The desired sound field can be provided, for example, from a device external to the sound field device or can be computed in the sound field device. For example, a BLU-RAY player can provide information about the desired sound field to the sound field device. In embodiments of the application, the sound field device is configured to compute the desired sound field from this external information about the sound field.

In embodiments, the sound field device of the first implementation has the advantage that for the low-frequency regions, the sound field device can generate or provide filter elements that can be used to generate a plurality of drive signals that again generate a sound field that matches the desired sound field as closely as possible, while also giving the desired elevated sound impression. In particular, the sound field can be specified at a predetermined number of control points.

In a second implementation of the sound field device according to the first aspect, the optimizer is configured to determine the one or more low-frequency filter elements u(k) as:

$$\min_{u(k)} \|H_b(k)u(k) - \mathrm{HRTF}_{el}(\theta,k)P_d\|^2$$

subject to $\|u(k)\|^2 \leq N_1$ and $\|H_j(k)u(k)\| \leq N_j$, where $N_j = \alpha M_1 \|\mathrm{HRTF}_{el}(\theta,k)\|^2 / M_j$ for $j \geq 2$, $N_1$ is a predetermined parameter, $H_b(k)$ is an acoustic transfer function matrix from the array of loudspeakers to the one or more bright zone control points inside the bright zone, $H_j(k)$ is an acoustic transfer function matrix from the array of loudspeakers to one or more quiet zone control points inside at least one quiet zone, $P_d$ is a desired sound field for the one or more control points, $M_1$ is a number of control points within the bright zone and $M_j$ is a number of control points within a j-th quiet zone, wherein $j \geq 2$.

The parameter $N_1$ is predetermined (e.g., adjustable by a user) and specifies a constraint on the loudspeaker array effort.

It should be noted that for a plurality of bright zones, a plurality of quiet zones for each of the bright zones may exist. In other words, the filter elements can be computed separately for each of the bright zones, and the resulting individual filter elements can be added to obtain an overall filter. For example, the sound field device can be configured to iteratively compute the filter elements for each of the bright zones and then compute the overall filter elements.

The sound field device of the second implementation provides a particularly accurate computation of the low-frequency filter elements.

In a third implementation of the sound field device according to the first aspect, the low-frequency filter estimator is configured to estimate the transfer function to the one or more control points by evaluating one or more 3D Green's functions with free-field assumption and/or by evaluating one or more measurements of a room impulse response.

Evaluating one or more 3D Green's functions represents a particularly efficient way of estimating the transfer function. Evaluating one or more measurements (e.g., by using one or more microphones that are positioned at the one or more control points) can provide more accurate results, but can involve a higher complexity.

In a fourth implementation of the sound field device according to the first aspect, the high-frequency filter estimator comprises a loudspeaker selection unit configured to select one or more active loudspeakers such that locations of the one or more active loudspeakers overlap with a projection of the bright zone on the array of loudspeakers. The high-frequency filter estimator further comprises a loudspeaker weight assigning unit configured to assign one or more frequency-dependent weights to the active loudspeakers.

For the high-frequency components of the sound, the sound field device of the fourth implementation assumes that the sound propagation mostly follows a line along a projection from the loudspeakers. Thus, in certain embodiments, the sound field device is configured to select only those loudspeakers where a projection of the loudspeakers overlaps with the selected loudspeakers. This provides a simple, yet efficient way of suppressing sound leakage to quiet zones outside the bright zone.

In a fifth implementation of the sound field device according to the first aspect, the loudspeaker weight assigning unit is configured to assign weights of $\sqrt{N_1/P}\ \mathrm{HRTF}_{el}(\theta,k)$ to the one or more active loudspeakers. P is a number of active loudspeakers and $N_1$ is a predetermined parameter.

This weighting of the active loudspeakers may ensure the constraint $\|w\|^2 \leq N_1$.

In certain embodiments, the cutoff frequency between the one or more low-frequency filter elements and the high-frequency filter elements is chosen based on a number of loudspeakers in the array of loudspeakers and/or based on a radius of the bright zone.

In a sixth implementation of the sound field device according to the first aspect, a cutoff frequency between the one or more low-frequency filter elements and the high-frequency filter elements is chosen as $(Q-1)c/4\pi r$. In this example, Q is a number of loudspeakers in the array of loudspeakers, r is a radius of the bright zone, and c is a speed of sound.

In certain embodiments, choosing the cutoff frequency according to $(Q-1)c/4\pi r$ has the advantage of analytically finding the optimal cut-off frequency that separates the low/high pass filtering bands according to the number of employed loudspeakers in the system. Two different strategies are applied to high and low frequency ranges so that the accurate rendering of the sound field with virtual elevation and the minimal inter-zone sound leakage can be achieved over the whole frequency range.

In a seventh implementation of the sound field device according to the first aspect, the elevation cue estimator is configured to estimate the elevation cue independent of an azimuth angle of the source relative to the bright zone.

This may provide a simplified and more efficient way of estimating the elevation cue. Experiments have shown that this represents an accurate approximation.

In an eighth implementation of the sound field device according to the first aspect, the elevation cue estimator is configured to compute the elevation cue according to:

$$HRTF_{el}(\theta, \phi, k) = \sum_{i=1}^{N} \frac{HRTF_i(\theta, 0, k)}{HRTF_i(\theta_s, 0, k)} \Big/ N$$

wherein $HRTF_i(\theta,0,k)$ is a HRTF of an i-th person. In other words, in certain embodiments, only the set of elevation cues for the median plane (i.e. $\phi=0$) is needed. This is based on the assumption that the elevation cues are symmetric in azimuth angle $\phi$ and are common in any sagittal planes.

Averaging over a large number N of persons may have the advantage that a better approximation of different head anatomies can be achieved. The computation of the elevation cues can be performed offline, i.e., they can be pre-computed and then stored on the sound field device.

A second aspect of the application refers to an audio system comprises a detector, a sound field device according to the first aspect or one of its implementations, a signal generator, and an array of loudspeakers. The detector is configured to determine an elevation of a virtual sound source relative to a listener. The sound field device is configured to determine a plurality of filter elements based on the determined elevation. The signal generator is configured to generate a driving signal weighted with the determined plurality of filter elements.

In certain embodiments, the detector can for example be configured to determine the elevation of the virtual source only from an input that is provided from a source specification. For example, a BLU-RAY disc can comprise the information that a helicopter sound should be generated with a "from directly above" sound impression. In other embodiments, the detector can be configured to determine the elevation of the virtual sound source based on a source specification and based on information about the location of the listener, in particular a vertical location of the listeners head. Thus, the determined elevation may be different if the listener is sitting or standing. To this end, the detector may comprise sensors that are configured to detect a pose and/or position of one or more listeners.

The detector, the sound field device and/or the signal generator may be part of the same apparatus.

The signal generator may be configured to generate a weak drive signal to be amplified before being used to drive the array of loudspeakers.

In a first implementation of the audio system of the second aspect, the array of loudspeakers is arranged in a horizontal plane, for placement in a car for example.

A third aspect of the application refers to a method for determining filter elements for driving an array of loudspeakers to generate an elevated sound impression at bright zone. The method includes estimating an elevation cue of an at least one listener. The method further includes estimating, using a first estimation method, one or more low-frequency filter elements based on the elevation cue, and estimating, using a second estimation method that is different from the first estimation method, one or more high-frequency filter elements based on the elevation cue.

In a first implementation of the method of the third aspect, the method is carried out for a plurality of source signals and a plurality of bright zones. Thus, bright zones for a plurality of users can be generated. The method can be configured to separately compute the filter elements for each of the bright zones (and the corresponding quiet zones) and then add the filter elements of all bright zones to obtain a set of filter elements that reflects all bright zones.

In a second implementation of the method of the third aspect, estimating the one or more low-frequency filter elements comprises determining the one or more low-frequency filter elements by optimizing an error measure between a desired sound field at one or more control points of the bright zone, weighted by the elevation cue, and an estimate of a transfer function that represents a channel from the array of loudspeakers to the one or more control points of the bright zone.

The method according to the third aspect of the application can be performed by the sound field device according to the first aspect of the application. Further features or implementations of the method according to the third aspect of the application can perform the functionality of the sound field device according to the first aspect of the application and its different implementation forms.

A fourth aspect of the application refers to a computer-readable storage medium storing program code, the program code comprising instructions for carrying out the method of the third aspect or one of its implementations.

BRIEF DESCRIPTION OF THE DRAWINGS

To illustrate the technical features of embodiments of the present application more clearly, the accompanying drawings provided for describing the embodiments are introduced briefly in the following. The accompanying drawings in the following description are merely some embodiments of the present application, but modifications on these embodiments are possible without departing from the scope of the present application as defined in the claims.

DETAILED DESCRIPTION OF ILLUSTRATIVE EMBODIMENTS

Figure 1:
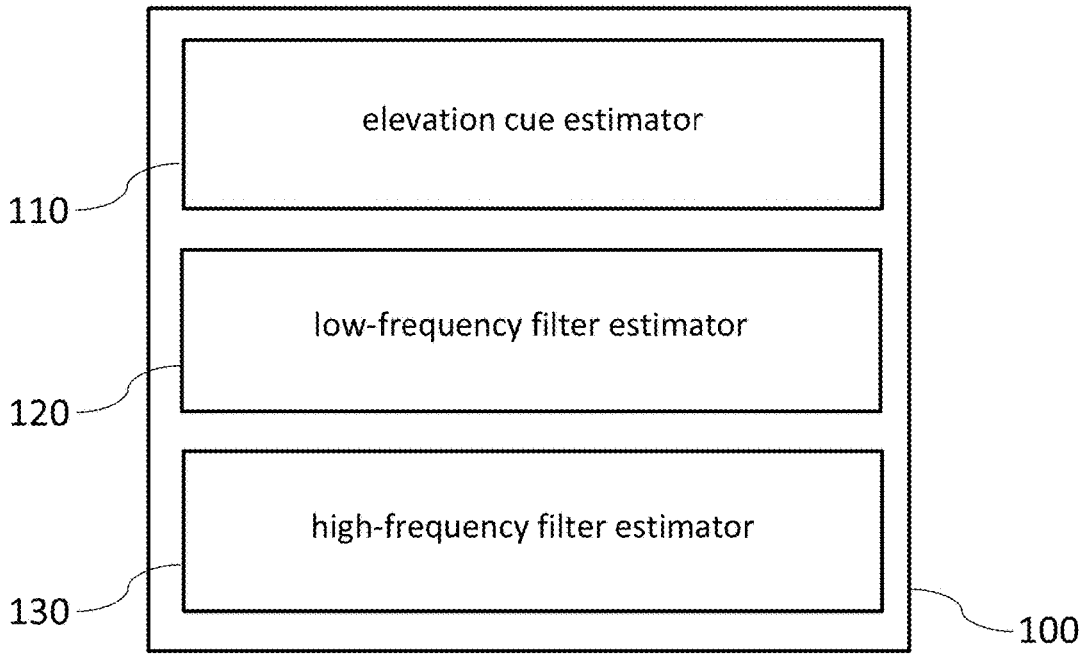
FIG. 1 shows a simplified block diagram of a sound field device in accordance with an embodiment of the application.

FIG. 1 shows a simplified block diagram of a sound field device 100 configured to determine filter elements for driving an array of loudspeakers to generate an elevated sound impression at a bright zone. Sound field device 100 comprises an elevation cue estimator 110 configured to estimate an elevation cue of a head-related transfer function (HRTF) of at least one listener, a low-frequency filter estimator 120 configured to estimate one or more low-frequency filter elements based on the elevation cue, and a high-frequency filter estimator 130 configured to estimate one or more high-frequency filter elements based on the elevation cue.

Elevation cue estimator 110, and low- and high-frequency filter estimators 120, 130 can be implemented in the same physical device, e.g., the same processor can be configured to act as elevation cue estimator 110, low-frequency filter estimator 120 and/or high-frequency filter estimator 130.

A (first) estimation method of low-frequency filter estimator 120 is different from a (second) estimation method of high-frequency filter estimator 130. For example, the first and second method can be different in the sense that they use different computational techniques for determining the low- and high-frequency filter elements.

Sound field device 100 can be configured to further comprise a signal generator (not shown in FIG. 1), which can be configured to generate a drive signal for the plurality of loudspeakers based on the filter elements computed by low- and high-frequency filter estimators 120, 130. For example, the signal generator can be configured to generate a plurality of driving signals for the plurality of loudspeakers by weighting an input signal with the low- and high frequency filter elements. For example, the low- and high-frequency filter elements can correspond to the plurality of loudspeakers, e.g., each of the filter elements corresponds to one of the loudspeakers.

Figure 2:
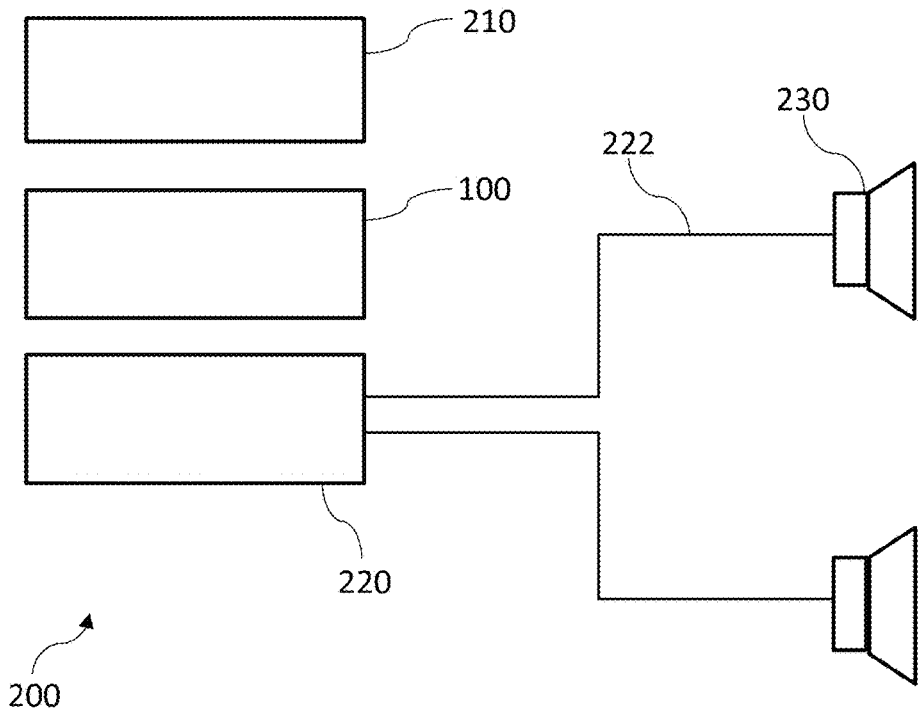
FIG. 2 shows a simplified block diagram of an audio system in accordance with a further embodiment of the application.

FIG. 2 shows a simplified block diagram of an audio system 200, which comprises a detector 210, a sound field device 100, a signal generator 220, and an array of loudspeakers 230. Detector 210 is configured to determine an elevation of a virtual sound source relative to a listener. Sound field device 100 (e.g., sound field device 100 of FIG. 1) is configured to determine a plurality of filter elements. Signal generator 220 is configured to generate a driving signal 222 weighted with the determined plurality of filter elements.

Detector 210, sound field device 100, and signal generator 220 can be part of one apparatus.

System 200 can further comprise an amplifier (not shown in FIG. 2), which amplifies drive signal 222 of signal generator 220 in order to drive the plurality of loudspeakers 230.

The array of loudspeakers 230 can be arranged in one horizontal plane. In other embodiments, the array of loudspeakers 230 can be arranged in different height levels. In certain embodiments, system 200 comprises a unit for determining an elevation level of the loudspeakers 230, such that the filter elements and thus the plurality of drive signals 222 can be computed with knowledge of the elevation level of each of the loudspeakers 230. To this end, the unit for determining the elevation level can comprise an input unit where a user can input information about the elevation level of the loudspeakers 230. In other embodiments, the unit for determining the elevation level can comprise a sensor for sensing an elevation level of the loudspeakers 230 without manual input from a user.

Figure 3:
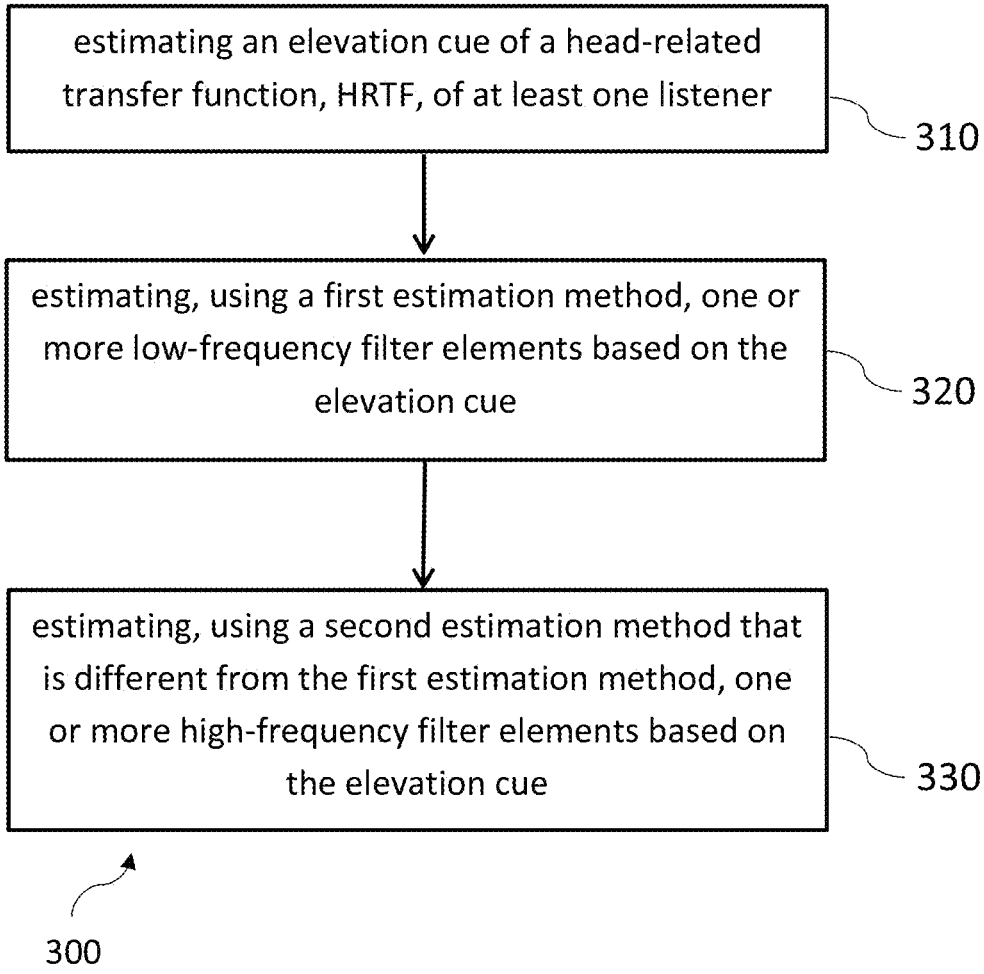
FIG. 3 shows a flow chart of a method in accordance with a further embodiment of the application.

FIG. 3 shows a flow chart of a method 300 for determining filter elements for driving an array of loudspeakers to generate an elevated sound impression at a bright zone. In a first step 310 an elevation cue of an HRTF of at least one listener is estimated. In a second step 320, using a first estimation method, one or more low-frequency filter elements based on the elevation cue are estimated. In a third step 330 using a second estimation method that is different from the first estimation method, one or more high-frequency filter elements based on the elevation cue are estimated.

Method 300 may comprise further steps (not shown in FIG. 4) of obtaining an input signal, weighting the input signal with the filter elements to generate a plurality of drive signals and/or amplifying the generated drive signals.

Figure 4:
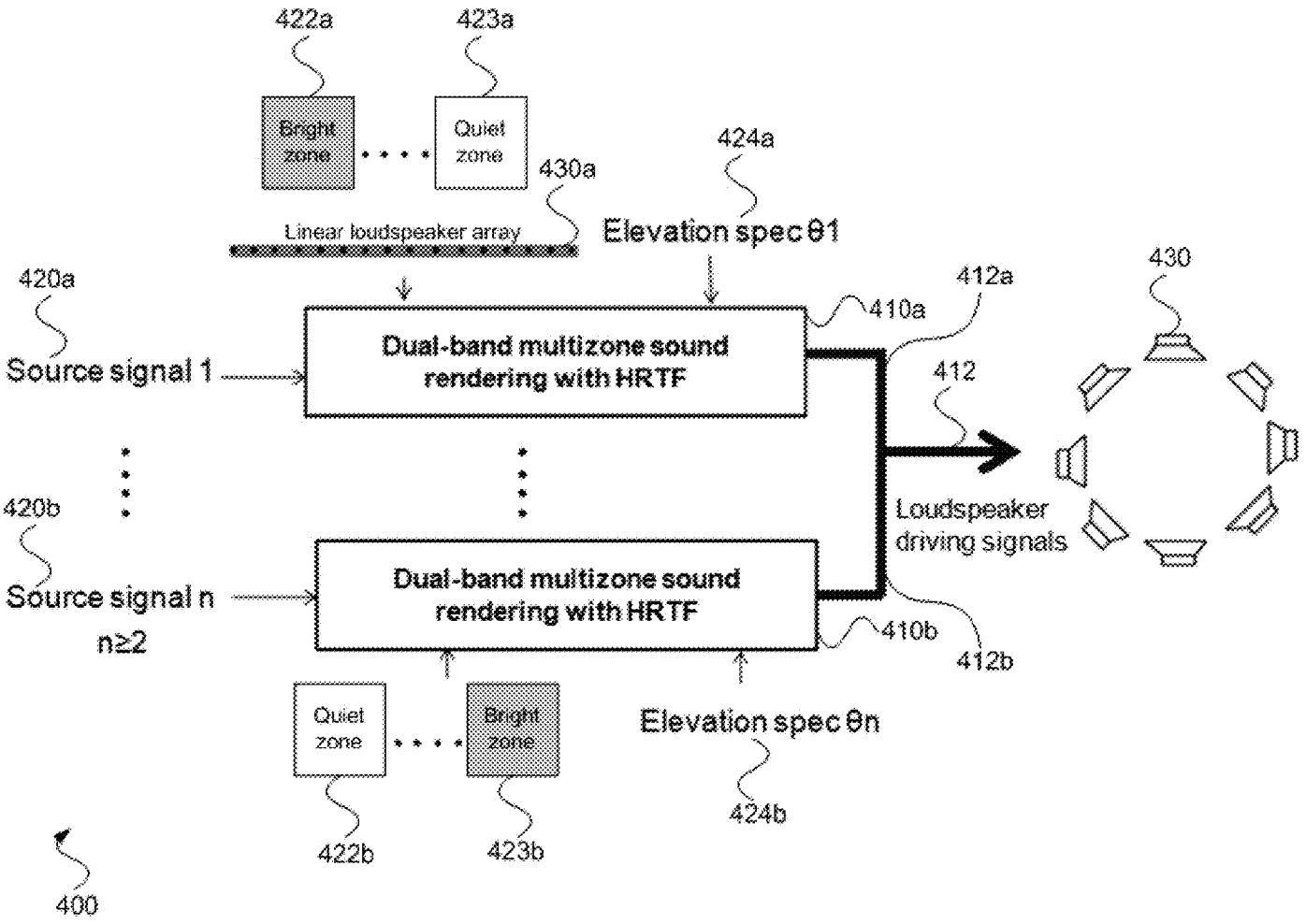
FIG. 4 shows a simplified block diagram of an audio system in accordance with a further embodiment of the application.

FIG. 4 shows an audio system 400 in accordance with an embodiment of the application. Audio system 400 comprises a plurality of dual-band multi-zone sound renderers 410. Each of the plurality of dual-band multi-zone sound renderers 410 comprises a low-frequency filter estimator and a high-frequency filter estimator.

As illustrated in FIG. 4, each of the dual-band sound renderers 410 is provided with information not only about n source signals, but also with information about n elevation specifications 424. An elevation specification can for example simply comprise an elevation angle θ relative to a listener. The dual-band sound renderers 410 further receive information about the bright and quiet zones 422*a*, 423*a*, 422*b*, 423*b* and about a setup of a linear loudspeaker array 430*a*. Based on this information, the dual-band sound renderers 410 can compute filter elements for each of the source signals. The individual filter elements 412*a*, 412*b* can then be combined and applied to an input signal (not shown in FIG. 4) in order to obtain the plurality of loudspeakers driving signals 412, which are used to drive the plurality of loudspeakers 430.

As illustrated in FIG. 4, the same zone 422*a* that acts as a bright zone for the first source signal 420*a* can act as a quiet zone 422*b* for a further source signal 420*b*. The zone 423*a* that was a quiet zone for the first source signal 420*a* is now a bright zone 423*b* for the further source signal 420*b*.

FIG. 4 is only meant as an illustration of the processing of a plurality of source signals. For example, the skilled person understands that in practice, a sound rendering device could be configured to iteratively compute filter elements for each of the source signals, e.g., only one rendering device could iteratively compute filter elements for a plurality of source signals.

Figure 5:
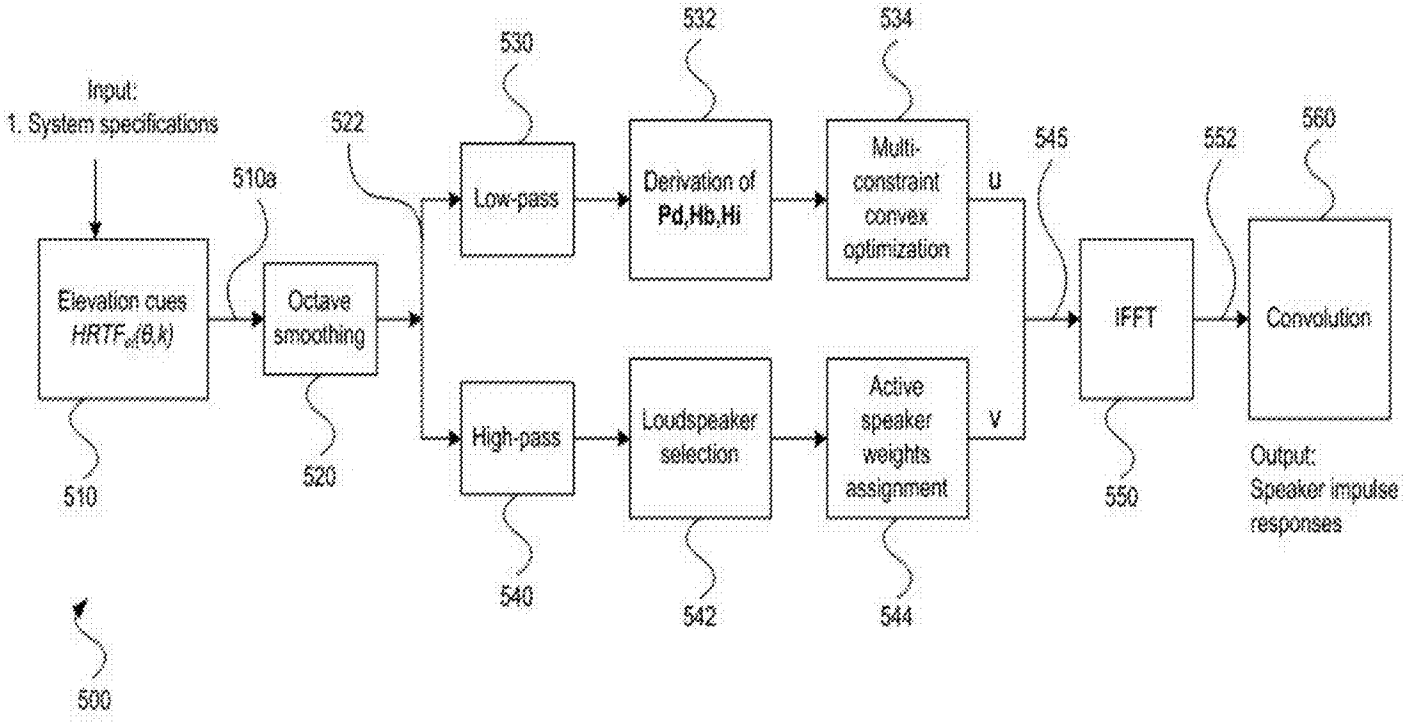
FIG. 5 shows a simplified flowchart of a dual-band multi zone sound rendering with elevation cues, in accordance with a further embodiment of the application.

FIG. 5 shows a simplified flowchart of a method 500 for dual-band multi zone sound rendering with elevation cues. In a first step 510, elevation cues $HRTF_{el}(\theta,k)$, indicated with reference number 510*a*, are computed based on a system specification. In a further step 520, the elevation cues are smoothed in an octave smoothing step. Subsequently, the processing is split-up, 522, depending on the frequency and in steps 530, 540 the processing is continued differently for low-pass and high-pass filter elements.

For the generation of the low-frequency filter elements, in step 532 the desired sound field $P_d$ and the transfer matrices $H_b$ and $H_j$ are computed. Subsequently, in step 534 a multi-constraint convex optimization is performed in order to determine the optimal low-frequency filter elements u.

For frequencies with $k \leq 2\pi f/c$ (low-pass filtering), wherein $k=2\pi f/c$, a joint-optimization with multi-constraint is formulated. A desired horizontal sound field in vector $P_d$ (dimension: $M_1 \times 1$) is defined for the control points within the bright zone. The desired sound field can be, for example, a plane wave function arriving from the speaker array or simply set to 1. The acoustic transfer function matrix from each loudspeaker to points inside the bright zone $H_b$ ($M_1 \times Q$), the acoustic transfer function matrix from each loudspeaker to points inside the quiet zones $H_j$ ($M_j \times Q$) (j=2 . . . n). The acoustic transfer of the loudspeakers can be derived following the 3D Green's function with free-field assumption or based on additional microphone measurements of the room impulse responses. The loudspeaker filtering weights vector w ($Q \times 1$). The acoustic transfer function can $M_1$ represents the number of control points within the selected bright zone and $M_j$ is the number of control points within the j-th quiet zone.

A multi-constraint optimization with the objective of minimizing the mean square error to the desired sound field with the consideration of HRTF elevation over the bright zone:

$$\min_w \|H_b w - P_d HRTF_{el}(\theta, k)\|^2$$

$$\text{subject to } \|w\|^2 \leq N_1 \text{ and } \|H_j w\|^2 \leq N_j,$$

$$\text{where } N_j = \alpha M_1 \|P_d HRTF_{el}(\theta, k)\|^2 / M_j.$$

a defines the acceptable level of sound energy leakage into the quiet zone and can be customized by users. $N_1$ specifies the constraint on the loudspeaker array effort.

The low-frequency filter elements u and the high-frequency filter elements v are merged to obtain a complete set of filter elements w, indicated with reference number 545. The filter elements are applied to a signal in frequency domain and an Inverse Fourier Transform is applied in step 550. On the resulting signal 552, a convolution 560 with speaker impulse responses is applied, which yields the output.

For the generation of the high-frequency filter elements (e.g., with wave numbers $k>(Q-1)/2r$, where Q is the number of speakers and r is the radius of each selected zone) in step 542 a loudspeaker selection is performed, and in step 544 weights are assigned to the selected active loudspeakers. This results in high-frequency filter elements v.

In the high-pass filter filtering, the reproduction accuracy may be undermined due to the limited number of employed loudspeakers, which may affect the desired listening experience, especially for the sensation of the elevation. Therefore, a different filter design strategy may be applied. At high frequencies, as the ratio of the size of the piston to the wavelength of the sound increases, the sound field radiated by the speaker becomes even narrower and side lobes appear.

Therefore, suppression of sound leakage at high frequencies can be achieved by exploiting the native directivity of the loudspeakers. The activated loudspeaker array partition may be selected such that it overlaps with the projection of the bright zone on the speaker array. It will be assumed that the number of selected loudspeakers is P. The loudspeaker weights assigned to the activated loudspeakers are $\sqrt{N_1/P}HRTF_{el}(\theta,k)$ in order to satisfy the constraint of $\|w\|^2 \leq N_1$.

After the derivation of the loudspeaker filtering gain in the frequency domain using a bin-by-bin approach, the output of the system, which is the finite impulse responses for the speaker array, can be obtained by performing an Inverse Fast Fourier Transform (IFFT). The derivation of the speaker impulse responses can be conducted offline (e.g., once for each car/conference room and its zone/loudspeaker set-up), if appropriate.

To fulfill the multi zone settings, filters that create n sets of one bright and (n−1) quiet zones setup over the selected regions are needed for n ($n \geq 2$) source signals (as shown in FIG. 4). The system features a combination of the HRTF elevation cues spectral filtering with horizontal multi zone sound field rendering system. An objective is to deliver the n input source signals simultaneously to n different spatial regions with various elevated sensations with the minimum inter-zone sound leakage via the 2D loudspeaker array.

To achieve this, a dual-band rendering system aiming to accurately reproduce the desired 3D elevated sound with the consideration of HRTF over the selected bright zone is provided. More specifically, a joint-optimization system with multiple constraints is applied to the filter design to minimize the reproduction to the desired 3D sound field over multiple listening areas at low frequencies. In contrast, the sound separation is achieved by a selection process of active loudspeakers at high frequencies and the characteristics of HRTF elevation cues may be preserved over the selected regions.

The HRTF elevation cues in FIG. 5 can be extracted, for example, from online public HRTF databases (e.g., the Center for Image Processing and Integrated Computing (CIPIC), University of California at Davis, HRTF database). The HRTF elevation cues are considered to be symmetric in azimuth angle $\phi$ and are common in any sagittal planes. With this assumption, in certain embodiments, only the set of elevation cues for the median plane (e.g., $\phi=0$) is needed. It may be advantageous to eliminate the filtering effect produced by a head exposed to a front coming sound and retain only the filtering effects due to elevation cues. For this purpose, the HRTF is normalized as follows:

$$HRTF_{el}(\theta, \phi, k) = \sum_{i=1}^{N} \frac{HRTF_i(\theta, 0, k)}{HRTF_i(\theta_s, 0, k)} \Big/ N$$

where $\theta_s$ is the elevation angle of the physical sources to the plane where the listeners' ears are locate. Therefore, in certain embodiments, the loudspeaker array is not only limited to the horizontal plane but can also be placed at other height levels (e.g., placed at the ceiling of the room or in a car).

The proposed dual-band rendering system in FIG. 5 may apply different strategies for accurately reconstructing the desired multi zone sound field with the consideration of HRTF cues, especially the features of HRTF elevation cues for both low and high frequency ranges. Important spectral features (e.g., peaks or notches) of the elevation cues appear at both low frequency ranges (e.g., below 2 kHz) and the frequency range beyond 8 kHz.

Figure 6:
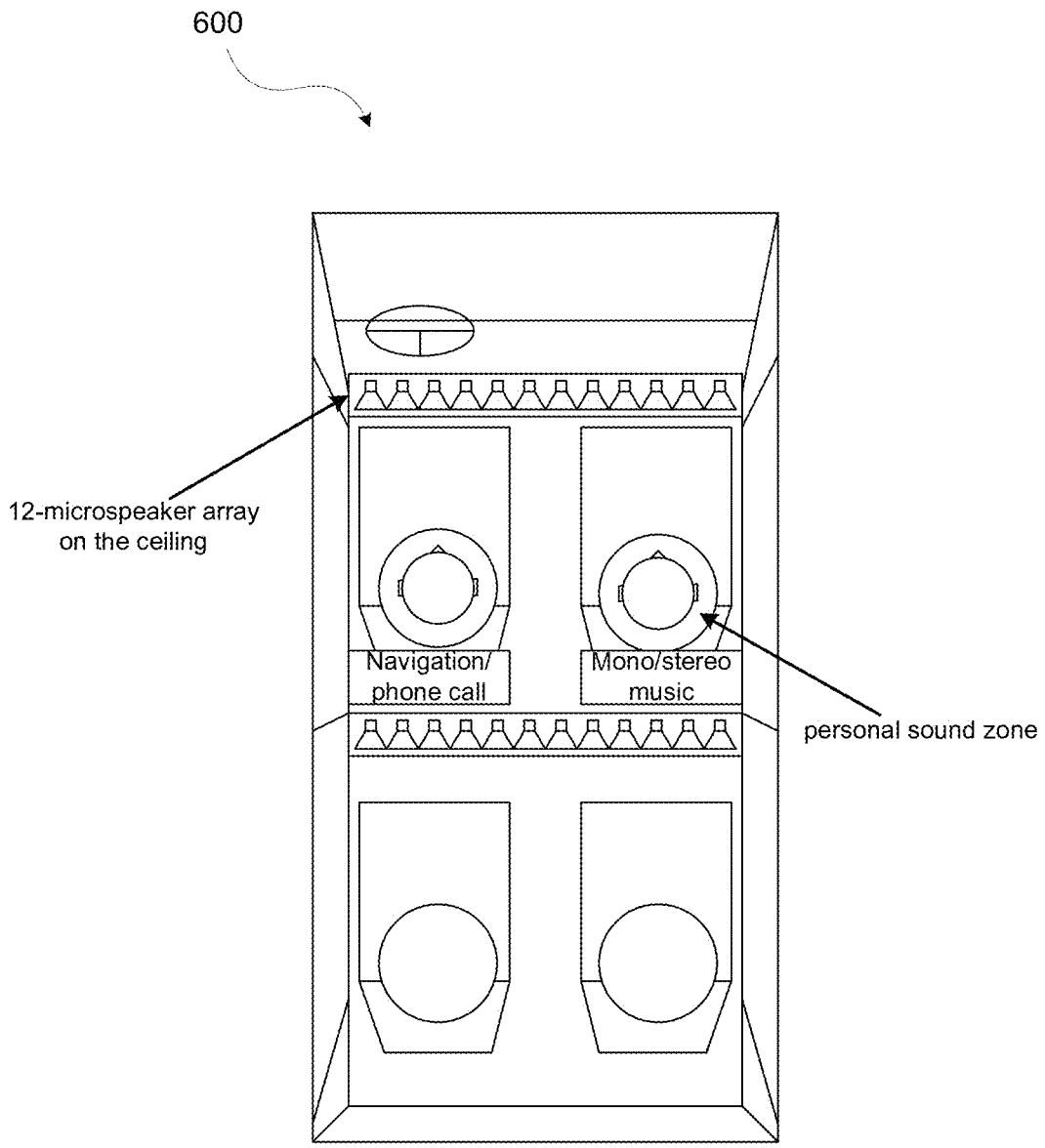
FIG. 6 is a simplified illustration of an application of a sound system in accordance with the present application in a car.

FIG. 6 illustrates how the audio system can be applied to a car audio system. Due to the spatial limitation in the car chamber, it is convenient to place an array of 12 micro-speakers at the ceiling of the car (e.g., over the passenger's head). The speaker array creates two separate personal zones for the driver and the co-driver seats. Two difference input audio signals (e.g., navigation speech stream for the driver and mono/stereo music for the co-driver) are delivered simultaneously to the two seat areas. Various virtual elevations can also be rendered for the different passengers. Therefore, the passengers can not only hear the sound from the top ceiling (which may lead to confusion), but also have the sensation that the sound is coming right in front in a 3D setting.

Advantages of certain embodiments of the application include:

In addition to the horizontal multi zone sound rendering, a more immersive elevated sensation can be provided in any location inside the selected zones of interests;

The joint-optimization formulation in the dual-band rendering system provides a more accurate reproduction of the desired sound field with the consideration of HRTF elevation over the selected zone, especially at low frequency range;

The application is capable of rendering different elevated virtual sources for various zones simultaneously;

No additional loudspeakers or changing the 2D loudspeaker setup are needed;

Limited additional computational cost.

The described sound field device and audio system can be applied in many scenarios, including, for example:

Any sound reproduction system or surround sound system with 2D loudspeaker array (most commonly used in existing products).

The elevation rendering in the application addresses the limitation due to 2D speaker setup and provides more immersive 3D virtual sound.

In particular examples, the sound field device and the audio system can be applied in the following scenarios:

a TV speaker system, a car entertaining system, a teleconference system, and/or a home cinema system, where the personal listening environments for one or multiple listeners are desirable.

The foregoing descriptions are only implementation manners of the present application; the protection of the scope of the present application is not limited to this. Any variations or replacements can be easily made through a person skilled in the art. Therefore, the protection scope of the present application should be subject to the protection scope of the attached claims.

What is claimed is:

1. A sound field device, comprising:

an elevation cue estimator configured to estimate an elevation cue of a head-related transfer function (HRTF) of at least one listener;

a low-frequency filter estimator configured to estimate, according to a first estimation technique, one or more low-frequency filter elements based on the elevation cue; and a high-frequency filter estimator configured to estimate, according to a second estimation technique, one or more high-frequency filter elements based on the elevation cue, the first estimation technique being different from the second estimation technique;

wherein:

the one or more low-frequency filter elements and the one or more high-frequency filter elements are for driving an array of loudspeakers to generate an elevated sound impression at a bright zone; and each of the low-frequency filter elements corresponds to a respective loudspeaker of the array of loudspeakers and each of the high-frequency filter elements corresponds to a respective loudspeaker of the array of loudspeakers.

2. The sound field device of claim 1, wherein the low-frequency filter estimator comprises an optimizer configured to determine the one or more low-frequency filter elements by optimizing an error measure between a desired sound field at one or more control points of the bright zone, weighted by the elevation cue, and an estimate of a transfer function that represents a channel from the array of loudspeakers to the one or more control points of the bright zone.

3. The sound field device of claim 2, wherein the optimizer is configured to determine the one or more low-frequency filter elements u(k) as:

$$\min_{u(k)} \|H_b(k)u(k) - \mathrm{HRTF}_{el}(\theta,k)P_d\|^2$$

subject to $\|u(k)\|^2 \le N_1$ and $\|H_j(k)u(k)\| \le N_j$, where $N_j = \alpha M_1 \|P_d \mathrm{HRTF}_{el}(\theta,k)\|^2 / M_j$ for $j \ge 2$, $N_1$ is a predetermined parameter, $H_b(k)$ is an acoustic transfer function matrix from the array of loudspeakers to the one or more bright zone control points inside the bright zone, $H_j(k)$ is an acoustic transfer function matrix from the array of loudspeakers to one or more quiet zone control points inside at least one quiet zone, $P_d$ is a desired sound field for the one or more control points, $M_1$ is a number of control points within the bright zone and $M_j$ is a number of control points within a j-th quiet zone, wherein $j \ge 2$.

4. The sound field device of claim 2, wherein the low-frequency filter estimator is configured to estimate the transfer function to the one or more control points by evaluating one or more of the following:

one or more three-dimensional (3D) Green's functions with free-field assumption; and one or more measurements of a room impulse response.

5. The sound field device of claim 1, wherein the high-frequency filter estimator comprises:

a loudspeaker selection unit configured to select one or more active loudspeakers such that locations of the one or more active loudspeakers overlap with a projection of the bright zone on the array of loudspeakers; and a loudspeaker weight assigning unit configured to assign one or more frequency-dependent weights to the one or more active loudspeakers.

6. The sound field device of claim 5, wherein the loudspeaker weight assigning unit is configured to assign weights of $\sqrt{N_1/P}\ \mathrm{HRTF}_{el}(\theta,k)$ to the one or more active loudspeakers, wherein P is a number of active loudspeakers and $N_1$ is a predetermined parameter.

7. The sound field device of claim 1, wherein a cutoff frequency between the one or more low-frequency filter elements and the one or more high-frequency filter elements is chosen as $(Q-1)c/4\pi r$, wherein Q is a number of loudspeakers in the array of loudspeakers, r is a radius of the bright zone, and c is a speed of sound.

8. The sound field device of claim 1, wherein the elevation cue estimator is configured to estimate the elevation cue independent of an azimuth angle of a source relative to the bright zone.

9. The sound field device of claim 1, wherein the elevation cue estimator is configured to compute the elevation cue according to:

$$HRTF_{el}(\theta, \phi, k) = \sum_{i=1}^{N} \frac{HRTF_i(\theta, 0, k)}{HRTF_i(\theta_s, 0, k)} \Big/ N$$

wherein HRTF (θ, 0, k) is a HRTF of an i-th person.

10. An audio system, comprising:

a detector configured to determine an elevation of a virtual sound source relative to a listener;

a sound field device configured to determine a plurality of filter elements based on the determined elevation of the virtual sound source;

a signal generator configured to generate a driving signal weighted with the determined plurality of filter elements; and an array of loudspeakers.

11. The audio system of claim 10, wherein the array of loudspeakers is arranged in a horizontal plane.

12. The audio system of claim 10, wherein:

the plurality of filter elements comprise one or more low frequency filter elements and one or more high-frequency filter elements, the one or more low-frequency filter elements and the one or more high-frequency filter elements are for driving the array of loudspeakers to generate an elevated sound impression at a bright zone;

the sound field device comprises:

a low-frequency filter estimator configured to estimate, according to a first estimation technique, one or more low-frequency filter elements based on an estimated elevation cue of a head-related transfer function (HRTF) of at least one listener; and a high-frequency filter estimator configured to estimate, according to a second estimation technique, one or more high-frequency filter elements based on the estimated elevation cue, the first estimation technique being different from the second estimation technique.

13. The audio system of claim 12, wherein the high-frequency filter estimator comprises:

a loudspeaker selection unit configured to select one or more active loudspeakers such that locations of the one or more active loudspeakers overlap with a projection of the bright zone on the array of loudspeakers; and a loudspeaker weight assigning unit configured to assign one or more frequency-dependent weights to the one or more active loudspeakers.

14. A method, comprising:

estimating an elevation cue of a head-related transfer function (HRTF) of at least one listener;

estimating, using a first estimation method, one or more low-frequency filter elements based on the elevation cue; and estimating, using a second estimation method that is different from the first estimation method, one or more high-frequency filter elements based on the elevation cue, the one or more low-frequency filter elements and the one or more high-frequency filter elements for driving an array of loudspeakers to generate an elevated sound impression at a bright zone, each of the low-frequency filter elements corresponds to a respective loudspeaker of the array of loudspeakers and each of the high-frequency filter elements corresponds to a respective loudspeaker of the array of loudspeakers.

15. The method of claim 14, wherein the method is performed for a plurality of source signals and a plurality of bright zones.

16. The method of claim 14, wherein estimating the one or more low-frequency filter elements comprises determining the one or more low-frequency filter elements by optimizing an error measure between a desired sound field at one or more control points of the bright zone, weighted by the elevation cue, and an estimate of a transfer function that represents a channel from the array of loudspeakers to the one or more control points of the bright zone.

17. A non-transitory computer-readable storage medium storing program code, the program code comprising instructions that, when executed by one or more processors, cause the one or more processors to perform operations comprising:

estimating an elevation cue of a head-related transfer function (HRTF) of at least one listener;

estimating, using a first estimation method, one or more low-frequency filter elements based on the elevation cue; and estimating, using a second estimation method that is different from the first estimation method, one or more high-frequency filter elements based on the elevation cue, the one or more low-frequency filter elements and the one or more high-frequency filter elements for driving an array of loudspeakers to generate an elevated sound impression at a bright zone, each of the low-frequency filter elements corresponds to a respective loudspeaker of the array of loudspeakers and each of the high-frequency filter elements corresponds to a respective loudspeaker of the array of loudspeakers.

18. The non-transitory computer-readable storage medium of claim 17, wherein the operations are performed for a plurality of source signals and a plurality of bright zones.

19. The non-transitory computer-readable storage medium of claim 17, wherein estimating the one or more low-frequency filter elements comprises determining the one or more low-frequency filter elements by optimizing an error measure between a desired sound field at one or more control points of the bright zone, weighted by the elevation cue, and an estimate of a transfer function that represents a channel from the array of loudspeakers to the one or more control points of the bright zone.

20. The non-transitory computer-readable storage medium of claim 19, wherein determining an estimate of the transfer function that represents a channel from the array of loudspeakers to the one or more control points of the bright zone by evaluating one or more of the following:

one or more three-dimensional (3D) Green's functions with free-field assumption; and one or more measurements of a room impulse response.

* * * * *